United States Patent [19]

Dinger et al.

[11] Patent Number: 4,715,281

[45] Date of Patent: Dec. 29, 1987

[54] IMPACT SWITCH FOR FUSES

[75] Inventors: Horst Dinger, Tennenbronn; Horst Moosmann, Schramberg, both of Fed. Rep. of Germany

[73] Assignee: Gebrüder Junghans GmbH, Schramberg, Fed. Rep. of Germany

[21] Appl. No.: 903,714

[22] Filed: Sep. 5, 1986

[30] Foreign Application Priority Data

Sep. 26, 1985 [DE] Fed. Rep. of Germany ..... 3534309

[51] Int. Cl.[4] ..... F42C 19/06

[52] U.S. Cl. ..... 102/216; 102/273

[58] Field of Search ..... 102/216, 273; 200/61.45 R

[56] References Cited

U.S. PATENT DOCUMENTS

| | | | |
|---|---|---|---|
| 2,952,208 | 9/1960 | Wagoner | 102/216 |
| 3,054,870 | 9/1962 | Wagoner | 102/216 |
| 3,158,705 | 11/1964 | Bliss | 102/216 |
| 3,368,044 | 2/1968 | Green et al. | 200/61.53 |
| 3,484,571 | 12/1969 | Williams | 200/61.53 |
| 3,927,286 | 12/1975 | Fohl | 200/61.45 R |

FOREIGN PATENT DOCUMENTS

| | | |
|---|---|---|
| 2305676 | 3/1980 | Fed. Rep. of Germany . |
| 1056492 | 2/1954 | France . |
| 2026346 | 9/1970 | France . |

*Primary Examiner*—Charles T. Jordan

*Attorney, Agent, or Firm*—Burns, Doane, Swecker & Mathis

[57] ABSTRACT

A switch is adapted for use in a projectile for actuating an electrical explosives-igniter in response to impact of the projectile. The switch includes a stationary electrical contact and a movable electrical contact. An actuator moves the movable contact against the stationary contact to complete an electric circuit in response to projectile impact. The actuator comprises a ball movable toward the movable contact. The ball is seated in a conical recess to enable the ball to move toward the movable contact even when the projectile does not impact along its longitudinal axis. The movable contact may comprise a cone-like array of flexible arms which engage the ball; movement of the ball flexes one or more of the arms into engagement with the stationary contact. Alternatively, the movable contact may comprise a linearly movable bolt engaged by the ball. A movable weight may be positioned behind the ball and adapted to engage the ball upon projectile impact to urge the ball toward the movable contact.

4 Claims, 3 Drawing Figures

IMPACT SWITCH FOR FUSES

BACKGROUND AND OBJECTS OF THE INVENTION

The invention concerns an impact switch for projectile fuses, in particular, for rocket projectiles wherein an electronic mechanism actuates the ignition of an explosive.

An electric percussion fuse is known from German Patent No. 23 05 676, which comprises two separate actuators, namely, a plunger 4 and a contact ring 24. The plunger is axially displaceable and, when depressed, bridges the contact tongues of a switch. The contact ring 24 is mounted flush in the outer surface of the projectile envelope, and is connected with switching elements or switching circuits of the fuse. This known electric percussion fuse is intended to immediately actuate the fuse and initiate the explosive charge even in the case of an extremely flat target impact angle. An expensive disadvantage of this known percussion fuse is the fact that to insure immediate ignition in the case of different impact angles, two separately acting switches are required. Thus, in case of a frontal impact of the fuse, ignition is effected by the axially displaceable plunger, while with extremely flat impact angles ignition is initiated by means of the contact ring in the envelope of the projectile.

It is the object of the invention to provide an impact switch of the afore-mentioned type, the operation of which is assured with an impact angle of 0° to 80° and when impacting at any point about the circumference of the fuse.

SUMMARY OF THE INVENTION

This object is attained wherein a switch housing includes a conical recess centered along the longitudinal axis of the housing. A movable member is disposed loosely in the recess and is movable along the conical beveled surface of the recess following the impact of the fuse in order to produce engagement between two electrical contacts. According to a preferred embodiment of the invention, the movable member is a ball. This ball may act against a contact in the form of a bolt. The bolt is movable toward the other contact against the force of a compression spring in response to projectile impact.

The impact switch according to the invention effects the ignition of the explosive charge in the case of impact angles of 0° to 80° . With a frontal impact of the impact switch, the ball moves longitudinally to press the spring loaded bolt directly against an electric contact. In case of an angular impact, the ball moves along the bevel of the conical recess in the general direction for producing interengagement of the contacts.

In a further embodiment of the invention, the spherical member may be contacted on a side thereof opposite the conical recess by a bell-shaped contact spring comprising several flexible contact arms, which arms define movable contacts. The contact spring is connected with a central, electrically conducting mounting screw. Following the movement of the body along the conical beveled surface upon projectile impact, at least one contact arm is pressed against the other contact which comprises a contact hood inserted in an electric insulation of the housing and connected with an electric terminal of the electronics of the fuse. The mounting screw may be fastened in the housing cover and may carry, by means of its head protruding inside the housing, both the contact spring and the electrical contacts. The conical recess may further pass into an essential cylindrical recess in a direction opposite to the contact spring, with a weight being situated loosely in the recess and arranged to act against the spherical member upon projectile impact. The contact spring may comprise a total of six contact arms distributed over the circumference.

In this embodiment of the impact switch, the spherical member acts, following the impact of the fuse on a target, always initially against the contact arms of a contact spring, which, in turn, contact the contact hood, thereby closing the current circuit. The contact arms of the hood-shaped contact spring have the advantage that they may be bent elastically with relative ease by the spherical body and are resting against the contact hood in a conducting manner. In the case of a frontal impact of the projectile, the spherical member spreads all of the contact arms. The weight is provided to aid in moving the spherical member.

BRIEF DESCRIPTION OF THE DRAWING

Preferred embodiments of the invention are illustrated in the drawings, in which.

DETAILED DESCRIPTION OF PREFERRED EMBODIMENTS OF THE INVENTION

Figure 1:
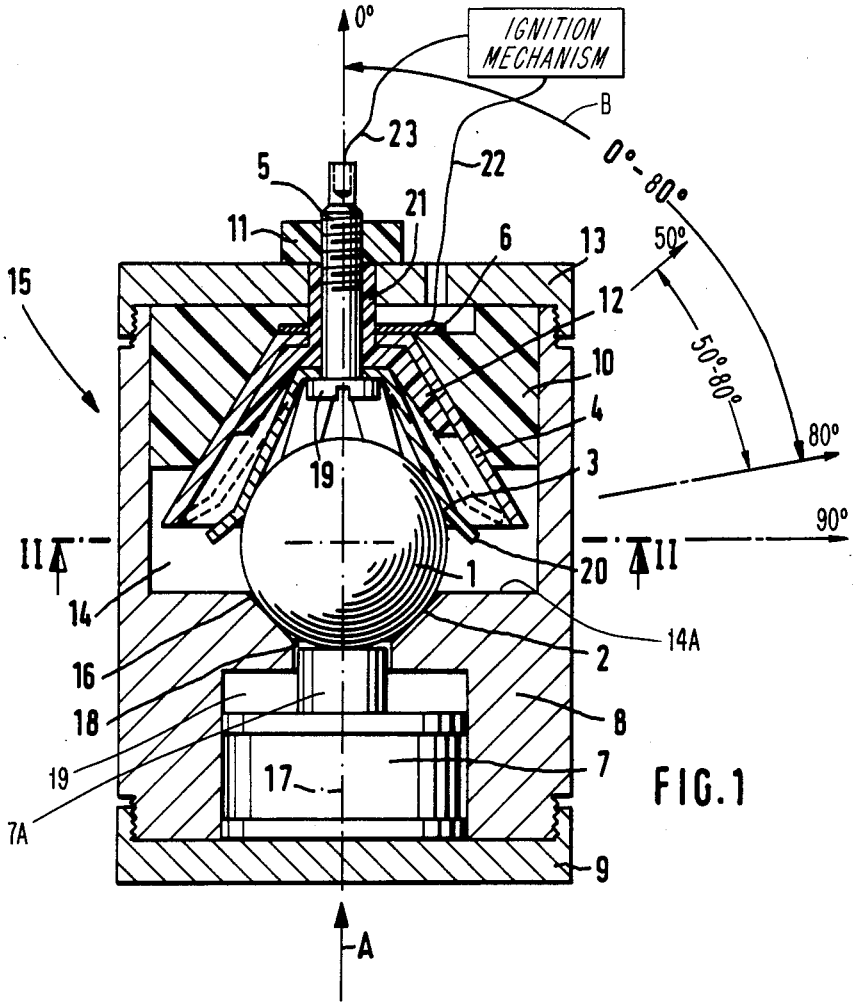
FIG. 1 is a longitudinal sectional view through the impact switch according to one embodiment of the invention.

An impact switch 15 according to the present invention comprises a housing 8, a cover 13 and a bottom 9. The cover and bottom are threadedly connected to the housing 8. A cylindrical recess 14 is located in the upper portion of the housing and is closed-off at its upper end by the cover 13. A generally frustoconical recess 16, defined by a beveled surface, is formed in a floor 14A of the recess 14 and is thus rigid. A lower end of the conical recess 16 communicates with a cylindrical recess 18 which is coaxial with the longitudinal axis 17 (i.e., the axis extending in a fore-to-aft direction) of the housing 8. A lower end of the recess 18 communicates with a larger cylindrical recess 19 the lower end of which is closed-off by the bottom 9. A weight body 7, which can be of cylindrical shape, is loosely situated in the recess 19. The body 7 includes a post 7A which extends into the recess 18.

A spherical body 1 is loosely situated in the conical recess 16 and is in point contact with the post 7A of the weight body 7. A mounting screw 5, centered along the longitudinal axis 17, is located above the ball in a direction opposite to the weight body 7. The screw 5 passes through the housing cover 13 such that the head 19 of the screw points in the direction of the body 1. The mounting screw 5 is fastened to the cover 13 by means of a plastic external nut 11.

An electrically insulative part 10 is disposed within an upper portion of the recess 14 and includes a frusto conical depression in which is situated an electrically conductive conical contact hood 4. Disposed within the contact hood 4 is an electrically insulative conical hood 12 which includes an upwardly extending neck 21 extending through aligned apertures in the contact hood 4, the part 10, a terminal lug 6, and the cover 13. The screw 5 projects through the neck 21, the latter terminating upwardly at the nut 11. An electrically conductive contact spring 3 is disposed within the insulative hood 12. The elements 3, 12, 4, 10, 6 and 13 are thus sandwiched together by the screw 5 and nut 11, such that the contact hood 4 electrically contacts the lug 6, and the electrically conductive screw 5 contacts the spring 3.

Figure 2:
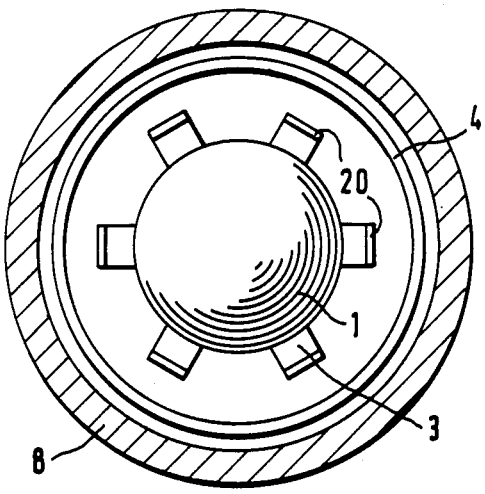
FIG. 2 is a cross-sectional view taken along line II—II in FIG. 1.

As seen in FIG. 2, the contact spring 3 comprises six contact arms 20 spaced apart circumferentially, all of which are abutting against the outer surface of the spherical body 1 in the rest position of the impact switch. Electrical conduits 22 and 23 of a conventional electronic igiting mechanism I are connected to the contact element 6 and the mounting screw 5, respectively, for providing an electrical signal to ignite the explosives. The impact switch is moved in the firing direction according to the arrow A and has an effective range of 0° to 80° as indicated by the arrow B.

In case of a frontal impact of the fuse, i.e., along the 0° line, the spherical body 1 is moved forward in the direction of the arrow A in the recess 14. In the process, the contact arms 20 of the contact spring 3 are spread apart and brought into contact with the inside of the bell-shaped contact hood 4. This spreading of the contact arms 20 is also induced by the weight body 7, 7A which moves forward in the direction of the spherical body 1 upon the impact of the fuse. The abutment of the contact arms 20 against the contact hood 4 establishes a connection from the screw 5 to the contact element 6. The current circuit is thereby closed and the pulse is passed through the conduit 22 and the conduit 23 to the electronic mechanism I of the fuse to effect ignition. The support of the spherical body 1 by the kinetic energy of the body 7 here depends essentially on the impact angle of the fuse, so that effective support is possible even in the case of angles greater than 0°.

With an impact angle of 50° to 80°, the spherical body 1 is able to press against one or more of the arms 20 of the contact spring 3, because the body 1 can roll along the bevel 2 at an angle relative to the longitudinal axis 17. Since at least one contact arm 20 is pressed against the contact hood 4, the electrical circuit is again closed. The electrical take-off is effected firstly through the mounting screw 5 which is in contact with the contact spring, and secondly, through the contact element in the form of a lug 6 connected electrically with the contact hood 4. At the impact angles 50° to 80°, the supplemental weight of the body 7 is not effective to push the body 1.

Figure 3:
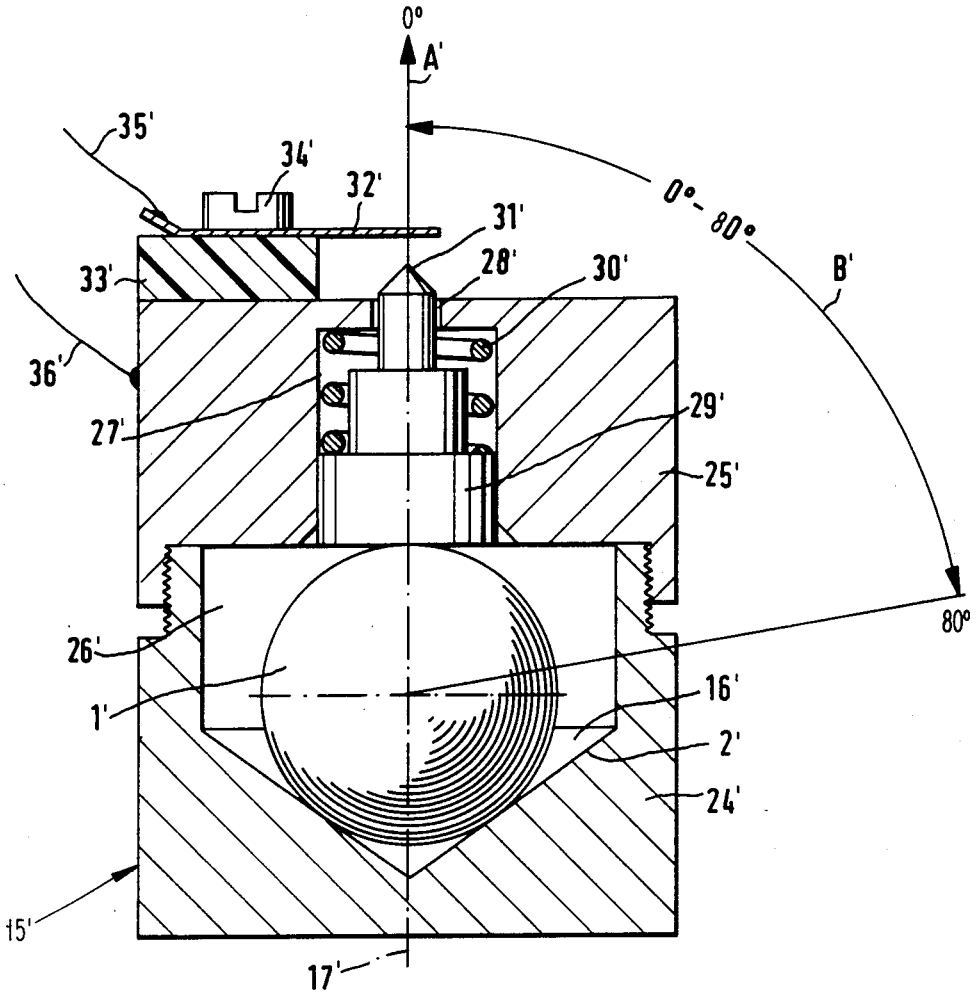
FIG. 3 is a longitudinal sectional view through an impact switch according to another embodiment of the invention.

FIG. 3 shows another preferred impact switch 15' according to the invention. The switch comprises a two-part housing 24', 25'. In the lower part 24' of the housing, a conical recess 16', formed by a bevel 2', is centered on the longitudinal axis 17' of the housing. In the conical recess 16' a spherical body 1' is loosely disposed. A cylindrical channel 27' forms an upward extension of the recess 26' and is centered on the longitudinal axis 17' of the housing 24', 25'. The channel 27' opens into a smaller, cylindrical terminal bore 28'. A bolt 29' is disposed movably in the channel and is exposed to the action of a compression spring 30'. The bolt 29' comprises at its upper end a point 31' which protrudes from the upper part of the housing part 25' and defines a movable contact intended to contact a fixed contact element 32'above the housing part 25'. The contact element 32' is joined to the housing part 25' by means of a screw 34'. An insulatinq piece 33' insulates the contact element 32' from the housing part 25'. The contact element 32' is connected to an electrical wire 35' which, together with a wire 36' joined with the housing part 25', is connected to an electronic mechanism (not shown) to actuate the ignition of explosives.

The operation of the embodiment illustrated in FIG. 3 is similar to that of the impact switch shown in FIG. 1. In case of a frontal impact of the fuse flying in the direction of firing A', the spherical body 1' moves in the direction of the bolt 29' and urges the latter against the force of the spring 30', such that the point 31' engages the contact element 32', whereby the circuit is closed.

If the fuse impacts at an angle from 50° to 80°, the spherical body 1' is moved on the conical bevel 2' so as to have directional components laterally and in the direction of the arrow A'. The spherical body 1' will thus press the bolt 29' against the contact element 32', thereby closing the circuit leading to the electronics of the fuse to ignite the explosive.

Although the present invention has been described in connection with preferred embodiments thereof, it will be appreciated by those skilled in the art that modifications, additions, substitutions and deletions may be made without departing from the spirit and scope of the invention as defined in the appended claims.

What we claim is:

1. An impact switch in a projectile of the type in which an electrical explosives-igniter is actuated in response to projectile impact, said switch comprising:

a housing comprising a rigid conical surface forming a conical recess centered along an axis extending in the fore-aft direction of the projectile, first and second contacts, at least one of which being movable into engagement with the other for completing an electrical circuit to actuate the explosives-igniter, and a spherical member movable in response to projectile impact for displacing said one contact into engagement with the other, said spherical member disposed in said recess so as to be movable along said rigid conical surface in directions angled relative to said axis to produce interengagement of said contacts in response to non-frontal impacts of the projectile, wherein said one contact comprises a contact spring having a plurality of flexible arms overlaying and contacting said spherical member so that at least one of said arms is flexed outwardly by said spherical member into engagement with said other contact, said other contact being hood-shaped and surrounding said arms.

2. An impact switch according to claim 1 including an insulating member interposed between said arms and said hood-shaped contact, and an electrically conducting screw securing said arms, said hood-shaped contact and said insulating member to said housing, said screw lying along said axis and being electrically connected to said arms and electrically insulated from said hood-shaped contact.

3. An impact switch according to claim 1 including a second recess communicating with a narrow end of said conical recess, a body loosely mounted in said second recess for movement toward and into engagement with said spherical member in response to projectile impact.

4. An impact switch according to claim 3, wherein there are six said flexible arms arranged in circumferentially spaced relationship.

* * * * *